United States Patent [19]

Hanson

[11] Patent Number: 4,765,490

[45] Date of Patent: Aug. 23, 1988

[54] FILE HANGER

[75] Inventor: Ray Hanson, Aurora, Canada

[73] Assignee: Commander Business Furniture, Inc., Agincourt, Canada

[21] Appl. No.: 942,193

[22] Filed: Dec. 16, 1986

[51] Int. Cl.[4] ..... A47F 5/00

[52] U.S. Cl. ..... 211/46; 211/175; 211/189; 312/184

[58] Field of Search ..... 211/189, 175, 46; 312/184

[56] References Cited

U.S. PATENT DOCUMENTS

| | | | |
|---|---|---|---|
| 2,226,763 | 12/1940 | Geih et al. | 211/194 X |
| 2,325,317 | 7/1943 | Hanna | 312/184 X |
| 2,336,802 | 12/1943 | Posner | 211/46 X |
| 3,295,697 | 1/1967 | Patterson | 312/184 X |
| 3,860,119 | 1/1975 | Irvine et al. | 211/189 X |
| 3,999,663 | 12/1976 | Walter et al. | 211/46 X |
| 4,319,688 | 3/1982 | Wahl | 211/175 |
| 4,475,657 | 10/1984 | Albery | 211/189 X |

*Primary Examiner*—Robert W. Gibson, Jr.

[57] ABSTRACT

The present invention provides a frame for hanging file folders which is size adjustable without requiring tools and without having to physically alter, as for example cutting any of the frame components. The frame consists of a set of opposing side rails, a set of opposing end rails and a plurality of upright leg members for supporting both sets of rails. Each side rail comprises overlapping side rail members which are longitudinally adjustable relative to one another for different length settings of the frame and releasable securing members securing and supporting the side rail members in the different length settings at spaced intervals along each side rail.

6 Claims, 4 Drawing Sheets

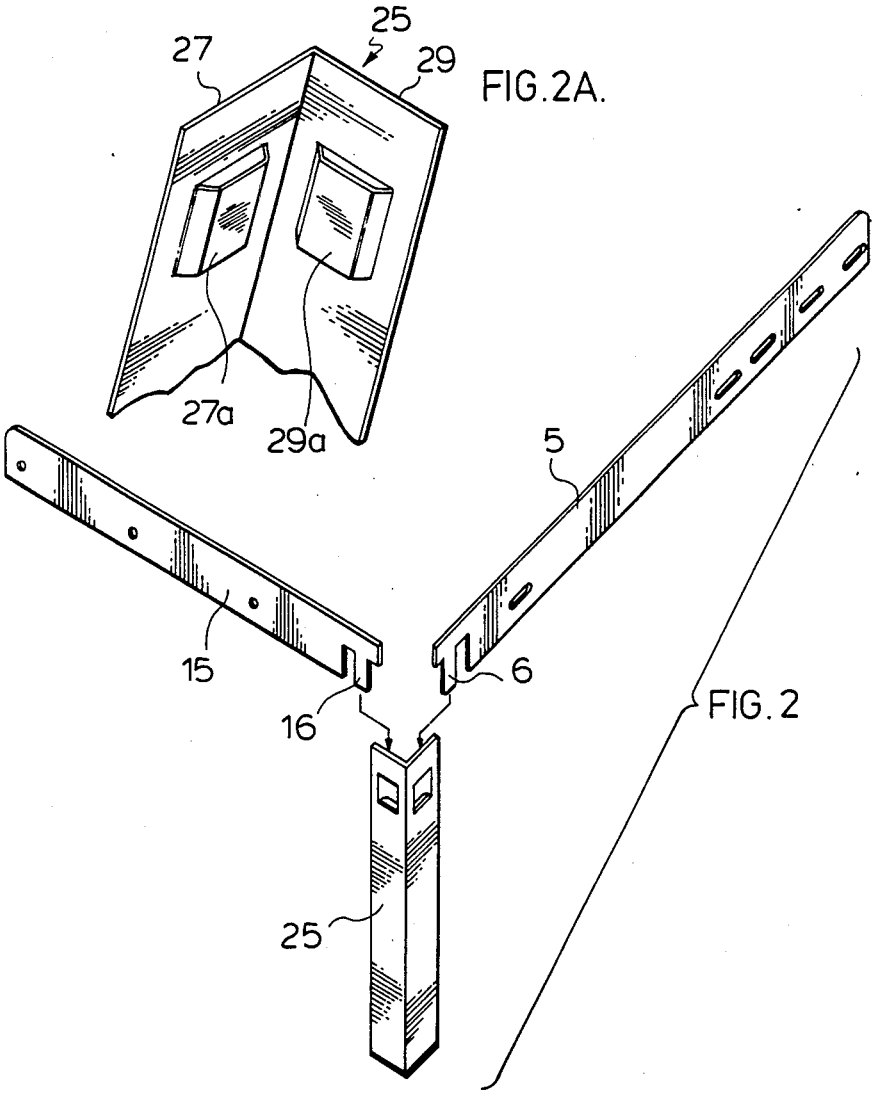
FIG. 2A.
FIG. 2
FIG. 4.
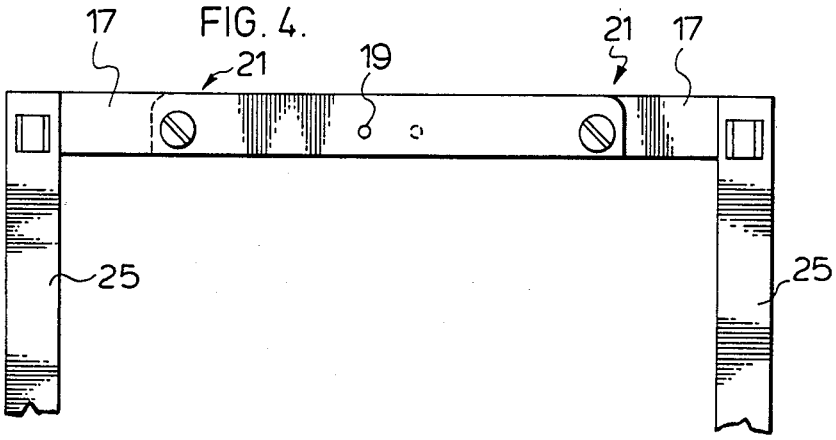

5
29
6
29a
27a
27

19
17
21
15
9
21
17
19

5
7
5

7
5
3
9
5
7

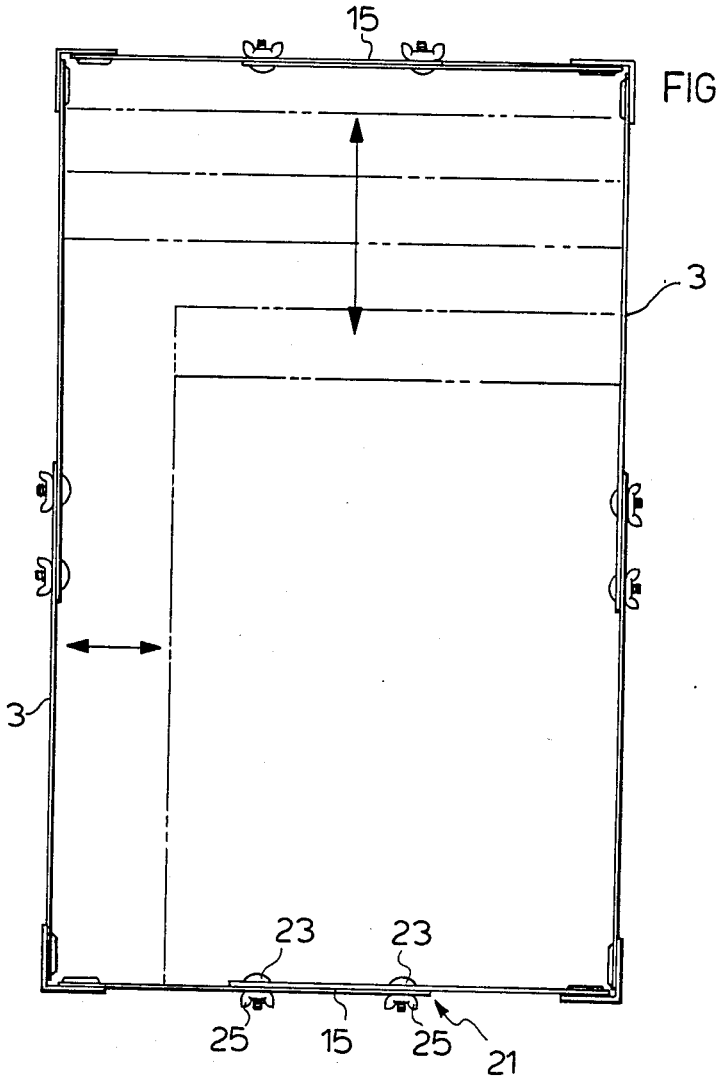
FIG. 8.
FIG. 9.
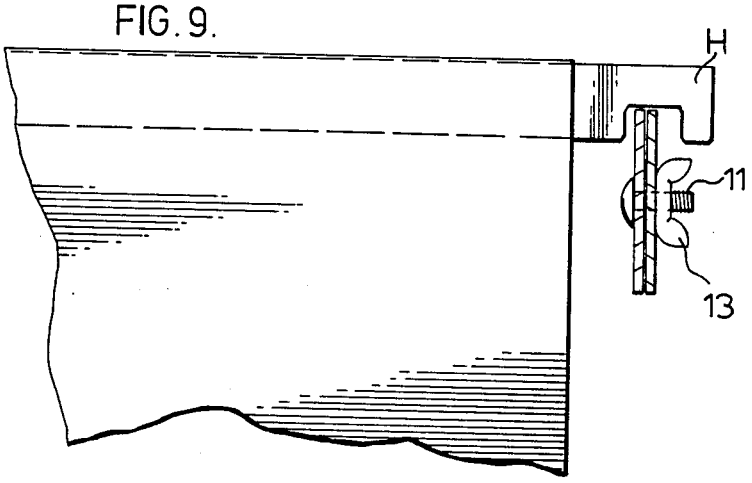

FILE HANGER

FIELD OF THE INVENTION

The present invention relates to a frame for supporting hanging file folders.

BACKGROUND OF THE INVENTION

Over the last few years, because of their versatility and ease of storage, there has been a increased demand for the use of hanging file folders. These folders are formed with outside edge hooks for fitting to a support frame specifically designed to receive the hanging file folders.

There are presently available many different types of frames although only about a handful have met with commercial success. One of the keys to these frames is that they be adjustable in length to fit in specifically sized filing cabinet drawers and also that they be adjustable in width to receive either letter or legal size files.

However, even the commercially accepted frames generally suffer from the major drawbacks that their adjustment requires the use of tools such as screw drivers, pliers and even hand saws which are not the type of items generally kept in an office environment. The reason that these tools are required is that the presently available frames are usually only adjustable by physically altering, i.e. cutting the frame components, to a desired length and then fixing the frame at that length through the use of screws or the like. Furthermore, once the frame has been cut to a specific length it can no longer be set to anything longer than that length for use in other drawer sizes.

SUMMARY OF THE PRESENT INVENTION

The present invention provides a frame for hanging file folders which is adjustable in length without requiring any tools and without having to physically alter any of the frame components. More particularly, the frame of the present invention consists of a set of opposing side rails, a set of opposing end rails and plurality of upright leg members for supporting both sets of rails. Each side rail comprises overlapping side rail members longitudinally adjustable relative to one another for different length settings of the frame and releasable securing means securing and supporting the side rail members in the different length settings at spaced intervals along each side rail.

According to a preferred embodiment of the present invention the releasable securing means comprises a nut and bolt combination including wing nuts which are easily hand tightened and releasable for adjusting the length of the frame to different filing cabinet sizes.

BRIEF DISCUSSION OF THE DRAWINGS

The above as well as other advantages and features of the present invention will be described according to the preferred embodiments of the present invention in which;

FIG. 2 is a further exploded perspective view of a corner assembly of the frame construction of FIG. 1.

FIG. 2*a* is an enlarged inside perspective view of the upright leg members shown in FIG. 2.

Figures 3, 5, 6, 7:
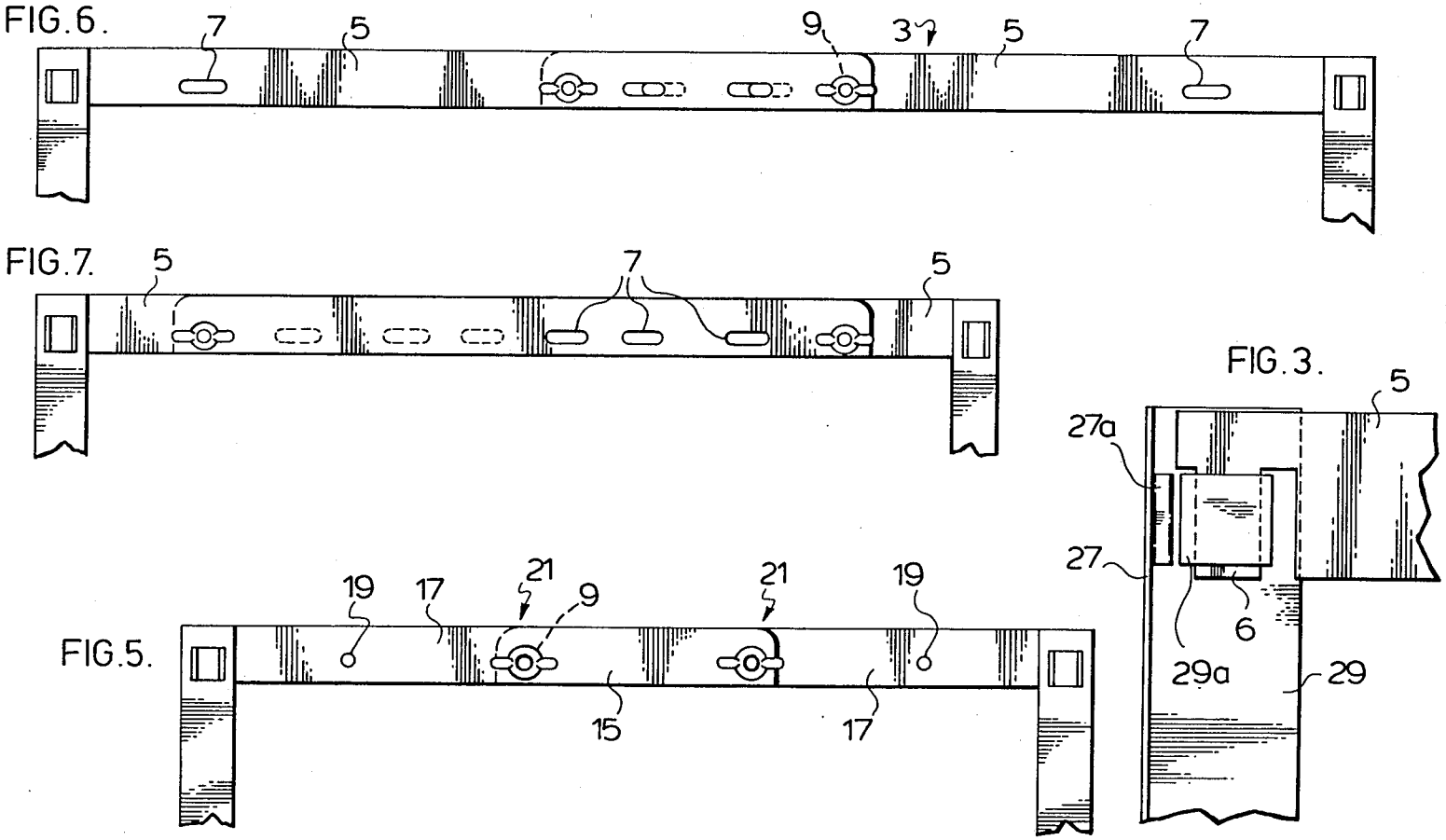

FIG. 3 is an assembled plan view of the leg and rail connection of the corner assembly of FIG. 2.

Figure 1:
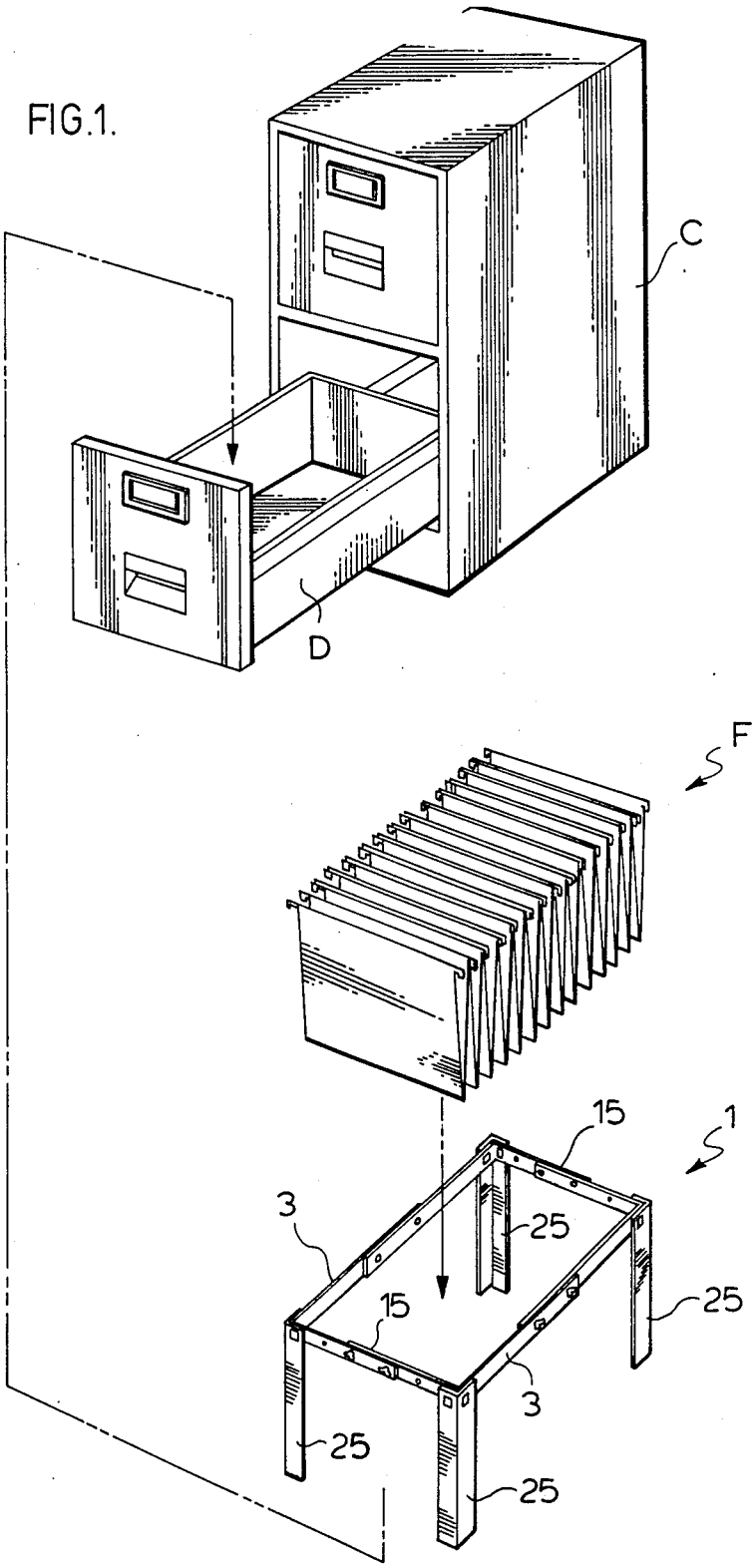
FIG. 1 is an exploded perspective view of a filing system for hanging file folders with a frame construction according to a preferred embodiment of the present invention.

FIG. 4, appearing on the same page as FIGS. 2 and 2*a*, and FIG. 5 are assembled end views showing different width settings of the frame of FIG. 1.

FIGS. 6 and 7 are assembled side views showing different length settings of the frame of FIG. 1.

FIG. 8 is a top plan view of the frame assembly of FIG. 1.

FIG. 9 is an enlarged sectional view along one of the side rails and its support of a hanging file folder from the frame assembly of FIG. 1.

DETAILED DESCRIPTION ACCORDING TO THE PREFERRED EMBODIMENTS OF THE PRESENT INVENTION

FIG. 1, as stated above, shows an office filing system which includes a filing cabinet C having a drawer 8 for receiving hanging file folders generally indicated at F. These file folders are hung from a frame generally indicated at 1 which is adjustable in width according to the type of files, i.e. letter or legal, and which is also adjustable in length to properly fit within the cabinet drawer.

Frame 1 is formed by a pair of opposing side rails 3, a pair of opposing end rails 15 and a plurality of upright leg members 25, one at each corner of the frame.

FIGS. 2 and 2*a* show the actual mounting of the side and end rails to the leg which acts as a corner juncture in supporting the frame. More particularly the leg itself includes first and second leg portions 27 and 29 at right angles to one another. These two leg portions are provided with pockets 27*a* and 29*a* respectively. These pockets are press formed directly from the leg members and therefore capable of supporting a very substantial load.

Each of the side and end rails consists of rail members 5 and 15 having downwardly extending tongues 6 and 16 respectively. These tongues are simply pressed downwardly into the pockets in the right angular construction leg member to a assemble one corner of the frame with similar assemblies being provided at the remaining frame corners. Here it should be noted that all of the upright leg members are of identical construction as are the end regions, including the tongues of the side and end rail members to that any one of the leg members can be used at any one of the frame corners thereby eliminating the possibility of incorrect assembly by the person putting the frame together.

The fit between the rail tongues and the leg pockets is frictionally secure to the extent that the entire frame can be lifted without its falling apart, while on the other hand, readily enabling intentional disassembly of the frame without requiring the use of any tools. In addition, the right angular construction of the leg itself, not only provides a unique and stable corner mounting for both the side and end rails but also, gives a good footing for stabilizing the frame in its assembled condition.

As described above the general assembly of the frame does not require any tools. In addition, the adjustability of the frame does not require any tools for varying the width and length frame settings as shown in FIG. 8 indicating, in solid lines, the maximum width and length settings and showing, in dotted lines, settings of decreasing width and length. Generally, there are only two width settings from a legal down to a letter sized file although other width settings can easily be accommodated. With respect to the length of the frame this setting is dependent upon the space in which the frame is to be stored and therefore as seen FIG. 8 is adjustable to many different length settings.

Referring first to FIGS. 6 and 7, each side rail comprises a pair overlapping side rail members 5 with rail member, in turn, having a series of elongated openings 7 along its length. The elongated openings are positioned on the two side rail members such that they align with one another at two spaced apart locations for the various different length adjustments of the side rail. These two aligning opening or slot locations are used to receive individual securing means 9. These securing means are in the form of a nut and bolt combination comprising a standard bolt 11 with a wing nut 13 fitted to the outside of the side rail as shown in FIG. 9. The outside positioning of the wing nut avoids any interference with the file F or its hanger H as can be clearly seen in the drawings.

The use of the nut and bolt combination, including the wing nuts again makes the side rail assembly quickly and easily adjustable without requiring the use of any tools whatsoever. Moveover, the adjustment itself is accomplished by simply sliding the side rail members along one another to the desired length and then fitting the nut and bolt combination through the two spaced apart aligned openings. For example, FIG. 6 shows a maximum setting for the side rail length while FIG. 7 shows a minimum side rail length setting. It should be noted in both cases the securing means not only secures but provides support for the side rails at two spaced apart locations along each rail.

From a commerical standpoint, the length of the frame is made to adjust over a distance of about 9 inches in relatively small increments as seen in FIG. 8 of the drawings. In the preferred form the frame is adjustable from a minimum setting of about 17 inches to a maximum setting of about 26 inches.

The width adjustment for the frame is substantially the same as the length adjustment except that in the preferred form it is only adjustable to either a wide legal size or a narrower letter size, again as seen in FIG. 8. More particularly, each of the end rails comprises a pair of overlapping end rail members 17 each of which is provided with a pair of openings 19. In both the legal and letter file set up the openings 19 of the two rail members align with one another at two spaced apart locations for receiving securing means generally indicated at 21 and comprising a bolt 23 and wing nut 25 identical to the nut and bolt combination described in use with the side rails. Again, the support provided by the nut and bolt combination is found at two spaced apart locations which eliminates any pivoting or rocking motion on the overlapping rail members which are simply slid in or out relative to one another to the appropriate frame width.

It will now be seen from all of the description above how the frame of the present invention, which is formed using inexpensive frame components is quickly and easily adjusted to many different frame sizes without requiring the use of any special tools and without having to physically alter any of the frame components thereby enabling the resetting of the frame after initial set up. Furthermore, the entire frame assembly is quickly and easily knocked down when desired for storage purposes.

Although various preferred embodiments of the invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A frame for hanging file folders, said frame consisting of a set of opposing side rails, a set of opposing end rails and four corner upright leg members for supporting both sets of rails, each side rail comprising a pair of side rail members and each side rail member having a series of spaced apart openings therein, the side rail members of each pair extending inwardly from and being removably secured at opposite ends of said frame and having an overlap with respect to one another by a span and an alignment of at least two openings in each of said side rails, said side rail members being longitudinally adjustable relative to one another by varying said overlap for different length settings of said frame and releasable securing means securing and supporting said side rail members at the two aligned openings in each side rail member.

2. A frame as claimed in claim 1, wherein each end rail comprises a pair of end rail members and each end rail member having a series of spaced apart openings therein, the end rail members of each pair extending inwardly from opposite corners of said frame and having an overlap with respect to one another by a span with an alignment of at least two openings in each of said end rail members, said end rail members being longitudinally adjustable relative to one another by varying said overlap for different width settings of said frame and releasable securing means for securing and supporting said end rails at the two aligned openings in each end rail member.

3. A frame, as claimed in claim 1, wherein said securing means comprises a plurality of nut and bolt combinations one at each of the aligning openings in both said overlapping side and end rail members, each nut and bolt combination including a wing nut for easy hand tightening and releasing of the combination.

4. A frame, as claimed in claim 1, and adjustable about 9 inches in length from a minimum to a maximum length setting and settable to numerous different frame lengths between said minimum and maximum length settings.

5. A frame, as claimed in claim 1, wherein said upright leg members are formed with first and second leg portions at right angles to one another, said first leg portion supporting one end of one of said side rails and said second leg portion supporting one end of one of said end rails, said first and second leg portions each being provided with rail receiving pockets and each of said side and end rail members being provided with tongues for frictionally engaging in said pockets.

6. A frame, as claimed in claim 3, wherein the wing nuts of said nut and bolt combinations are located to the outside of said side and end rails and are dropped downwardly from the upper edges thereof to avoid interference with files hanging from said frame.

* * * * *